US012320241B2

(12) United States Patent
Bo

(10) Patent No.: US 12,320,241 B2
(45) Date of Patent: Jun. 3, 2025

(54) METHODS AND SYSTEMS EMPLOYING AUTONOMOUS CHOKE CONTROL FOR MITIGATION OF LIQUID LOADING IN GAS WELLS

(71) Applicant: Schlumberger Technology Corporation, Sugar Land, TX (US)

(72) Inventor: Jiangwei Bo, Beijing (CN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/448,233

(22) Filed: Aug. 11, 2023

(65) Prior Publication Data

US 2024/0052729 A1 Feb. 15, 2024

(30) Foreign Application Priority Data

Aug. 11, 2022 (CN) ..... 202210961074.6

(51) Int. Cl.
*E21B 43/12* (2006.01)
*E21B 47/047* (2012.01)

(52) U.S. Cl.
CPC ..... *E21B 43/122* (2013.01); *E21B 43/12* (2013.01); *E21B 47/047* (2020.05); *E21B 2200/20* (2020.05)

(58) Field of Classification Search
CPC .... E21B 2200/20; E21B 43/12; E21B 43/122; E21B 47/047; E21B 34/02; E21B 34/14;
(Continued)

(56) References Cited

U.S. PATENT DOCUMENTS 6,883,606 B2 * 4/2005 Evans ..... E21B 43/121 166/250.15
6,991,034 B2 * 1/2006 Wilde ..... E21B 43/12 166/263

(Continued)

FOREIGN PATENT DOCUMENTS

CN 110469316 A 11/2019
WO WO-2024036309 A1 * 2/2024 ..... E21B 43/122

OTHER PUBLICATIONS

Search Report and Written Opinion of International Patent Application No. PCT/US2023/072086 dated on Nov. 24, 2023, 11 pages.

(Continued)

*Primary Examiner* — Daniel P Stephenson
(74) *Attorney, Agent, or Firm* — Aashish Y. Chawla; Jeffrey D. Frantz

(57) ABSTRACT

Methods and systems are provided for controlling intermittent production of gas in association with liquids from a well. Production tubing disposed in the well provides a flow path for gas and liquids to the surface. An electrically-controlled choke and a controller are disposed at the surface. The choke is in fluid communication with the production tubing. The controller interfaces to the choke and executes autonomous control operations that control operation of the choke, wherein the autonomous control operations involve production cycles that include a production mode followed by a shut-in mode. In the production mode, the controller is configured to operate the choke in an open position. In the shut-in mode, the controller is configured to operate the choke in a closed position.

20 Claims, 10 Drawing Sheets

(58) Field of Classification Search
CPC ..... E21B 41/00; E21B 43/16; E21B 43/34; E21B 47/00; G06F 19/00
See application file for complete search history.

(56) References Cited

U.S. PATENT DOCUMENTS

| | | | | |
|---|---|---|---|---|
| 7,957,841 | B2 * | 6/2011 | Zarowny | F04B 49/00 73/1.16 |
| 10,508,420 | B2 * | 12/2019 | Epp | E03B 3/08 |
| 11,268,349 | B2 * | 3/2022 | Weatherhead | E21B 41/00 |
| 2004/0200615 | A1 | 10/2004 | Wilde | |
| 2007/0012442 | A1 * | 1/2007 | Hearn | E21B 43/121 166/250.15 |
| 2011/0060472 | A1 * | 3/2011 | Ocondi | E21B 47/06 700/282 |
| 2012/0318523 | A1 | 12/2012 | Wlde et al. | |
| 2017/0356279 | A1 * | 12/2017 | Nandola | E21B 41/00 |
| 2022/0214474 | A1 * | 7/2022 | Nistala | E21B 47/10 |
| 2024/0052729 | A1 * | 2/2024 | Bo | E21B 43/12 |

OTHER PUBLICATIONS

Li, et al., "New View on Continuous-Removal Liquids From Gas Wells", In SPE Production & Facilities, May 15-16, 2001, vol. 17, No. 01, 06 pages.

* cited by examiner

Critical Gas Flow Rate $U_{cr}$ $= v_c = 2.5\sqrt[4]{\frac{(\rho_l - \rho_g)\sigma}{\rho_g^2}}$ Critical Gas Flow Rate Qc $= 2.5 * 10^4 * \frac{APU_{cr}}{ZT}$

| | |
|---|---|
| σ | Interface tension |
| $\rho_g$ | Gas density |
| $\rho_l$ | Liquid density |
| P | Wellhead pressure |
| A | Tubing cross sectional area |
| Z | Compressibility factor |
| T | Wellhead temperature |

FIG. 4

| Gas rate | Liquid height | Differential Liquid height | Liquid loading or not |
|---|---|---|---|
| $Q \geq Q_c$ | Don't Care | Don't Care | No |
| | | Don't Care | No |
| | Don't Care | Don't Care | No |
| | | Don't Care | No |
| $Q < Q_c$ | $H_l >$ Value A | Don't Care | Yes |
| | | Don't Care | Yes |
| | $H_l \leq$ Value A | $\Delta H_l >$ Value B | Yes |
| | | $\Delta H_l \leq$ Value B | Q < Value C; Yes |
| | | $\Delta H_l \leq$ Value B | Q ≥ Value C; No |

FIG. 6

METHODS AND SYSTEMS EMPLOYING AUTONOMOUS CHOKE CONTROL FOR MITIGATION OF LIQUID LOADING IN GAS WELLS

CROSS REFERENCE TO RELATED APPLICATIONS

This application claims priority to Chinese patent application number 202210961074.6 filed on 11 Aug. 2022, which is incorporated by reference.

FIELD

The present disclosure relates to methods and systems that mitigate liquid loading in gas wells.

BACKGROUND

Gas wells often produce both gas (natural gas) and liquid. The liquid can include connate water, water-based frac fluid, or gas condensate. If the production stream of gas and liquid has a velocity greater than a critical gas velocity, the liquid is carried with the gas to the surface. If the production stream of gas and liquid has a velocity less than the critical gas velocity, the liquid is not carried with the gas to the surface and can accumulate in the wellbore. Such liquid accumulation is referred to as liquid loading. The liquid loading can limit or even stop the production of gas from the gas well.

One method of mitigating liquid loading in gas wells is referred to as intermittent production, which involves operating the gas well in successive bimodal production cycles that include a production mode followed by a shut-in mode. In the production mode, the choke at the wellhead is open to enable both gas and liquid to be produced at the surface. During the production mode, the well can experience liquid loading. In the shut-in mode, the choke is closed to stop production of both gas and liquid at the surface. During the shut-in mode, liquid can flow from the wellbore back into the reservoir rock to reduce liquid loading and permit the bottomhole pressure to recover for the next production cycle.

One problem with intermittent production is that it is difficult to determine the timing of the choke adjustments that determine the duration of both the production mode and shut-in mode of the production cycles in a manner that effectively mitigates liquid loading and optimizes the production of gas from the well over time. Historically, the timing of the choke adjustments is based on pre-selected time periods. However, the use of such pre-selected time periods typically does not effectively mitigate liquid loading and optimize the production of gas from the well over time because the production parameters considered for this task are different in every well and the parameters associated with a single well change over time.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Methods and systems are provided for controlling production of gas in association with liquids from a well in a manner that mitigates liquid loading in the well. Production tubing disposed in the well provides a flow path for gas and liquids to the surface. An electrically-controlled choke and a controller are disposed at the surface. The choke is in fluid communication with the production tubing, and the controller interfaces to the choke. The controller executes autonomous control operations that control operation of the choke. The autonomous control operations involve production cycles that include a production mode followed by a shut-in mode. In the production mode, the controller is configured to operate the choke in an open position. In the shut-in mode, the controller is configured to operate the choke in a closed position.

In embodiments, in the production mode, the controller is configured to perform operations that involve:

i) determining a liquid height over time from a first computational model, wherein the liquid height represents height or depth level of liquid loading in the well, and wherein the first computational model is based on the conversation of energy for the production flow through the production tubing;

ii) determining whether a liquid-loading flag is true or false over time based at least in part on values for the liquid height over time in the production mode, and iii) automatically and selectively transitioning to the shut-in mode based on the liquid-loading flag.

In embodiments, the first computational model can be configured to relate measured operating parameters (such as gas flow rate, tubing head pressure, casing head pressure, and combinations thereof) and static parameters (such as gas density, liquid density, wellbore depth, and combinations thereof) to the liquid height.

In embodiments, the first computational model can be based on fluid mechanics with assumptions that (a) liquid height in the annulus of the well outside the production tubing is negligible, and (b) production from the well will be the stable flow, which means that kinetic energy loss is negligible.

In embodiments, the first computational model can employ an iterative method that calculates a value for a compressibility factor for the fluid flow.

In embodiments, the first computational model can be configured to calculate bottomhole pressure from measured casing head pressure, and then use the calculated bottomhole pressure together with measured tubing head pressure and values for gas density, liquid density, and wellbore depth to determine the liquid height.

In embodiments, the determination of the liquid-loading flag over time is further based on comparing measured gas flow rate to a critical gas flow rate determined from another computation model.

In embodiments, the determination of the liquid-loading flag over time is further based on differential liquid height calculated during the production mode.

In embodiments, during the shut-in mode, the controller can be configured to perform operations that involve: i) determining a liquid height over time from a second computational model, wherein the liquid height represents height or depth level of liquid loading in the well, and wherein the second computational model is based on the conversation of energy for static fluids in the well; ii) determining an observation time window where the liquid height over time in the shut-in mode falls below a threshold level; iii) predicting gas flow rate for different points in time within the observation time window using a trained machine learning model; iv) identifying a point in time in the observation window that corresponds to a maximum predicted gas flow rate within the observation time window; and v) automatically and selectively transitioning to the production mode at the point in time identified in iv).

In embodiments, the second computational model can be based on fluid mechanics with assumptions that (a) liquid height in the annulus of the well outside the production tubing is negligible, and (b) there is no production from the well such that kinetic energy loss and friction loss can be omitted from the calculation.

In embodiments, the second computational model can employ an iterative method that calculates a value for a compressibility factor for the fluid.

In embodiments, the second computational model can be configured to calculate bottomhole pressure from measured casing head pressure, and then uses the calculated bottomhole pressure together with measured tubing head pressure and values for gas density, liquid density, and wellbore depth to determine the liquid height.

In embodiments, the threshold level can be determined from analysis of historical data.

In embodiments, the trained machine learning model can implement a Decision Tree model, Random Forest ML model, an XG Boost ML model, an Artificial Neural Network model, or another suitable ML model.

In embodiments, the machine learning model is trained from historical times-series operational data collected during intermittent production from a number of gas wells and stored in a database.

In embodiments, the historical time-series operational data is preprocessed for modeling.

In embodiments, the preprocessing of the historical time-series operational data can include data extraction operations and data labeling operations, wherein the data extraction operations are configured to extract or calculate relevant or meaningful feature data for respective shut-in periods, and the data labeling operations are configured to assign labels or tags to the feature data, wherein the labels or tags are indicative of the gas flow rate for the production periods that follow the respective shut-in periods.

In embodiments, the label or tag assigned to the feature data for a given shut-in period can be calculated as the average gas flow rate measured during the production period that follows the given shut-in period.

In embodiments, similar data extraction operations can be performed on time-series operational data collected in the shut-in mode to extract or calculate relevant or meaningful feature data for the shut-in mode for input to the trained machined learning model.

In embodiments, the controller can be configured to operate the choke in a fully open or other fixed open setting in the production mode over time.

In embodiments, the controller can be configured to operate the choke in variable open settings in the production mode over time.

In embodiments, the controller can be configured to operate the choke in variable open settings based on predictions of the gas flow rate made by the ML model for different open settings of the choke.

In embodiments, the controller can be implemented by a gateway device located at or near a well site, wherein the gateway device is configured to collect real-time operational data related to production of gas and liquids from the well.

In embodiments, the controller can be implemented by a cloud computing environment that communicates with a gateway located at or near a well site, wherein the gateway is configured to collect real-time operational data related to production of gas and liquids from the well and to forward the real-time operational data to the cloud computing environment.

In embodiments, some or all of the autonomous control operations are performed by at least one processor.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein:

FIG. 4 is a diagram illustrating a computational model for calculating critical gas flow rate;

FIG. 6 is a table whose rows represent conditions that can be evaluated in the production mode to determine whether a liquid-loading flag is true or false;

DETAILED DESCRIPTION

Figure 1:
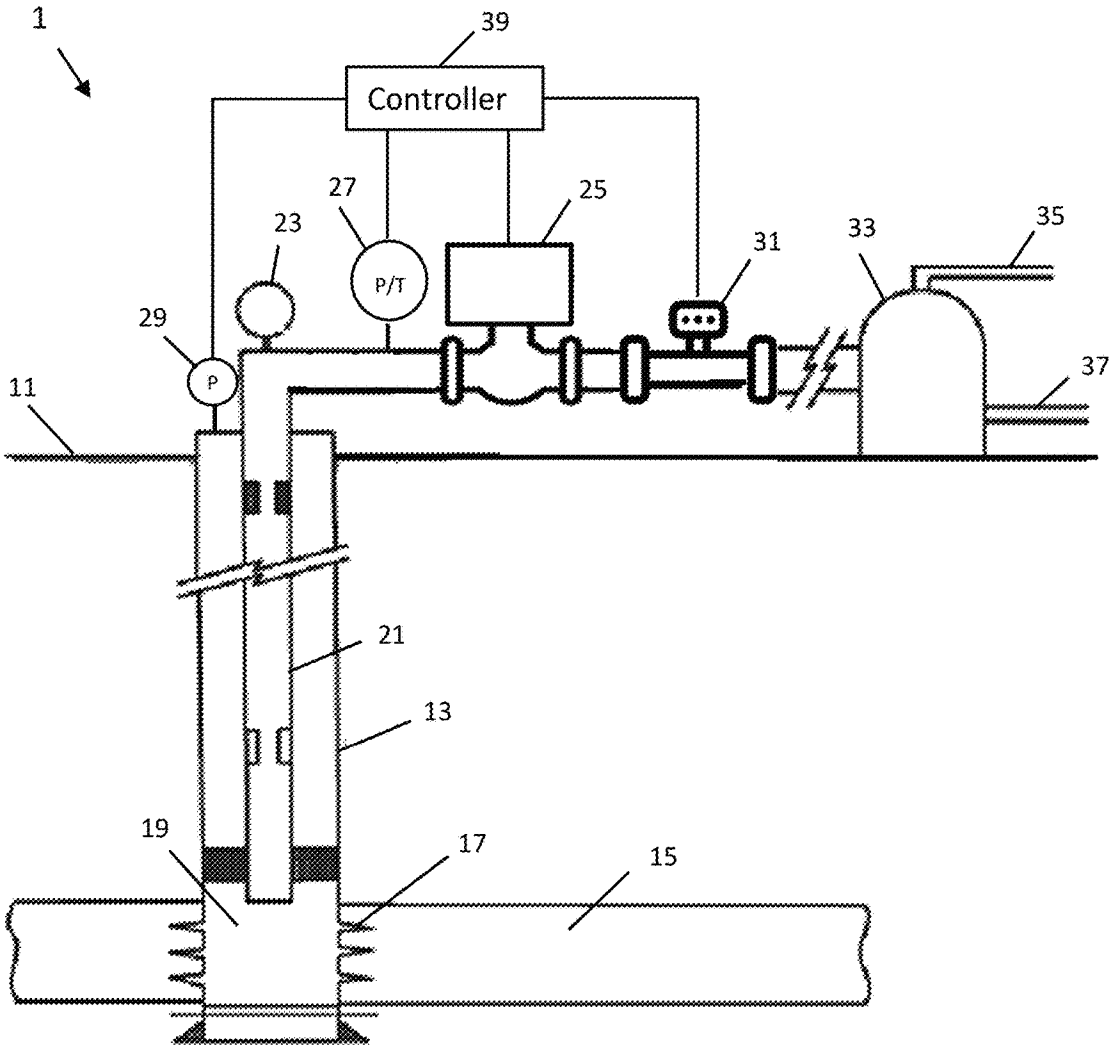
FIG. 1 is a schematic illustration of a gas well that embodies aspects of the present disclosure.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc., may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both, objects, or steps, respectively, but they are not to be considered the same object or step.

The terminology used in this disclosure is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

FIG. 1 is a schematic view of aspects of the present disclosure applied to a gas well 1, which includes a wellbore 13 which is lined with casing (not shown). The wellbore 13 extends from the earth's surface 11 downward such that it traverses a subterranean reservoir (e.g., reservoir rock) 15 that holds gas (also commonly referred to as natural gas) and liquid. The liquid can include connate water, water-based frac fluid, gas condensate, or other liquids. The wellbore 13 includes perforations 17 that provide for fluid communication (i.e., the flow of gas and liquid) between reservoir 15 and the bottomhole interval 19 of the wellbore 13. A string of production tubing 21 is co-axially disposed within the wellbore 13. The tubing 21 extends upward to a wellhead 23 located at the surface 11. The tubing 21 provides a flow path for gas and liquids from the buttonhole interval 19 to the surface 11.

At the surface 11, the tubing 21 is fluidly coupled to an electrically-controlled choke 25. The choke 25 can be embodied by an electrically-controllable needle valve or another suitable electrically-controlled valve. Surface-located pressure and temperature sensors (labeled 27) are configured to measure the tubing head pressure and wellhead temperature, respectively, upstream of the choke 25. A surface-located pressure sensor 29 is configured to measure casing head pressure. A surface-located flow meter 31 is configured to measure the flow rate of gas (or gas flow rate) in the production stream downstream of choke 25. The flow meter 31 can embody various types of flow meters, such as ultrasonic flow meters, thermal mass flow meters, or other suitable flow meters. A surface-located separator 33 is configured to separate out gas from the production stream downstream of the flow meter 31. Gas exits separator 33 through a delivery line 35 leading to a sink, such as a scrubber or pipeline or storage facility. Separator 33 can also be configured to separate out water and possibly gas condensate from the production stream downstream of the flow meter 31. The water and possibly gas condensate can be discharged from separator 33 through one or more delivery lines (one shown as 37) that lead to a surface facility, such as a water disposal system for water, or a stock tank for gas condensate.

Figure 2:
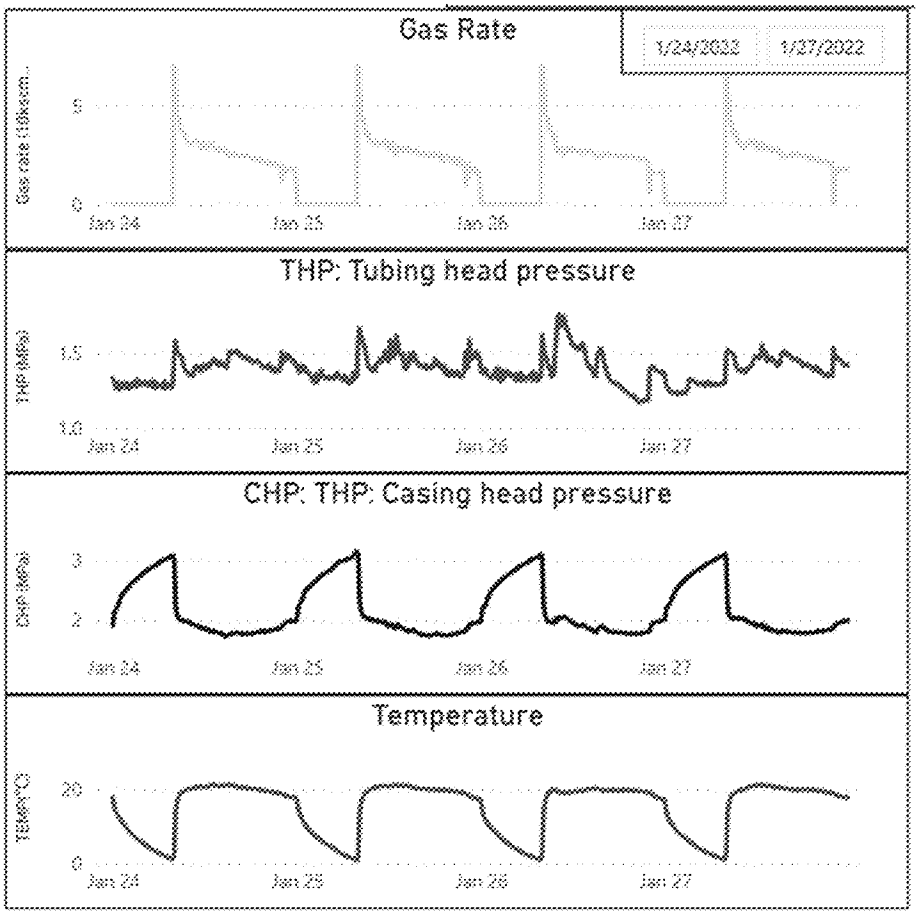
FIG. 2 illustrates time-series operational data that can be measured by the sensors of the gas well of FIG. 1 during the production cycles of the well.

A surface-located controller 39 is also provided, which includes one or more data communication interfaces to the choke 25, the pressure and temperature sensors 27, the pressure sensor 29, the flow meter 31, and possibly other surface equipment or downhole equipment. The data communication interface(s) can employ standard or proprietary wired or wireless communication protocols. The data communication interface(s) can be configured to provide for communication of time-series operational data to controller 39. The time-series operational data can include i) data representing the values of pressure and temperature measured by the sensors 27, 29 over time, and ii) data representing the value of gas flow rate measured by the flow meter 31 over time. The controller 39 can collect and store the time-series operational data for processing as described herein. Examples of such time-series operational data are shown in FIG. 2. The data communication interface(s) can be configured to provide for communication of commands that control the operation of the choke 25, such as to set the choke in an open configuration for the production mode or to set the choke in a closed configuration for the shut-in mode or as described herein.

Figure 3:
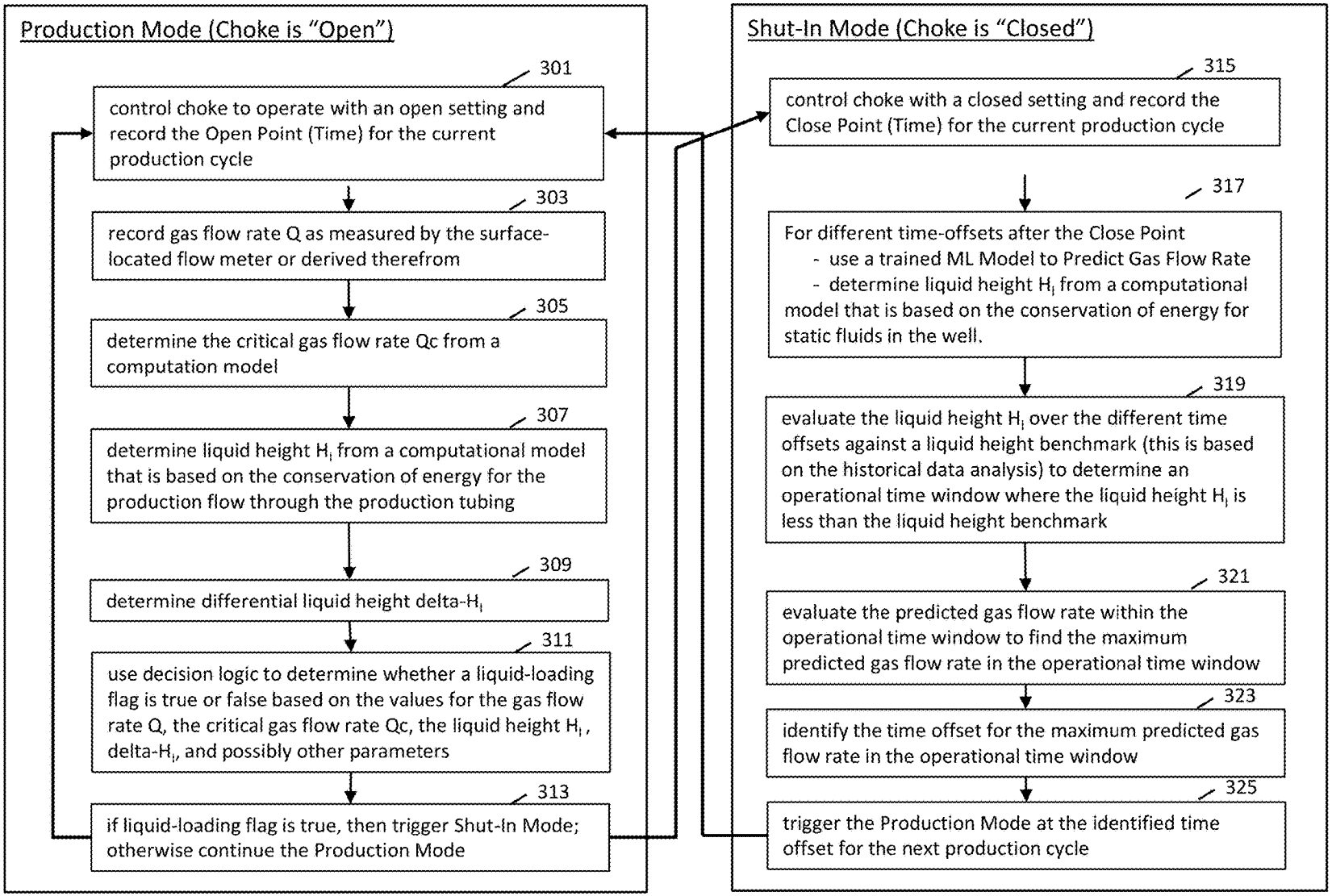
FIG. 3 is a flow chart that illustrates autonomous control operations carried out by the controller of FIG. 1 that dynamically adjusts or controls the choke to carry out intermittent production. The intermittent production employs successive production cycles that include a production mode followed by a shut-in mode.

In embodiments, controller 39 can be configured to implement autonomous control operations that dynamically adjusts or controls the choke 25 to carry out intermittent production according to the process of FIG. 3. The intermittent production employs successive bimodal production cycles that include a production mode followed by a shut-in mode. In the production mode, choke 25 is open to enable both gas and liquid to be produced at the surface 11. During the production mode, the well can experience liquid loading. In the shut-in mode, choke 25 is closed to stop production of both gas and liquid at the surface 11. During the shut-in mode, liquid can flow from the wellbore 13 back into the reservoir rock 15 to reduce liquid loading and permit the bottomhole pressure to recover for the next production cycle. The production mode is shown on the left side of FIG. 3, and the shut-in mode is shown on the right side of FIG. 3.

The production mode begins in block 301 where controller 39 controls choke 25 to operate with an open setting and records the Open Point (Time) for the current production cycle.

In block 303, controller 39 records a gas flow rate Q as measured by the surface-located flow meter 31 or derived from such measurements. The casing head pressure, tubing head pressure, temperature, and other parameters can also be measured and recorded.

In block 305, controller 39 determines the critical gas flow rate Qc from a computation model. The critical gas flow rate Qc represents the minimal gas flow rate to avoid liquid loading of the well. If the gas flow rate Q is greater than the critical gas flow rate Qc, it is assumed that liquid loading will not occur. If the gas flow rate Q is less than the critical gas flow rate Qc, it is assumed that liquid loading can possibly occur based on the operating parameter of the well. There are many different models that can be used to determine the critical gas flow rate Qc, such as the Tuner model or the Li Min model. In embodiments, the computational model of block 305 can be based on the Li Min model as summarized in FIG. 4. Note that the value of the constant parameter in FIG. 4 is 2.5. In other embodiments, another value (such as 5.5, 6.6, or some other value) can be used for the constant parameter.

Figure 5:
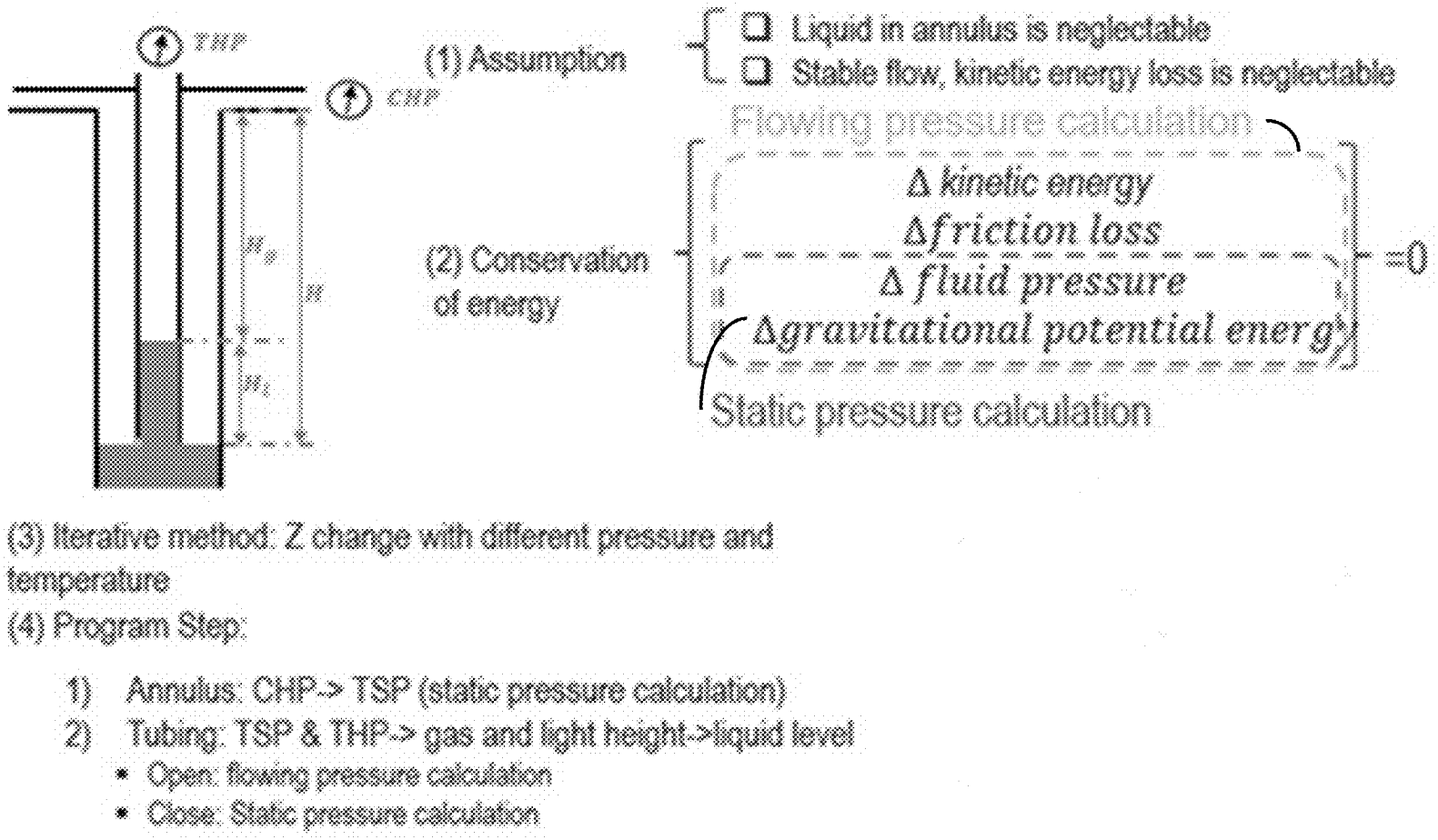
FIG. 5 is a schematic diagram that illustrates a computational model that determines a liquid height based on the conservation of energy for the production flow through the production tubing in the production mode of FIG. 3. The liquid height represents the height or depth level of the liquid loading in the well.

In block 307, controller 39 determines a liquid height $H_l$ from a computational model that is based on the conservation of energy for the production flow through the production tubing. In embodiments, the liquid height $H_l$ represents the height or depth level of the liquid loading in the well as illustrated in FIG. 5.

In embodiments, the computational model of block 307 is configured to relate measured operating parameters (such as gas flow rate, tubing head pressure, and casing head pressure) and static parameters (such as gas density, liquid density, and wellbore depth) to liquid height $H_l$. In embodiments, the computational model of block 307 can be based on fluid mechanics with assumptions (1) that (a) liquid height in the annulus of the well outside the production tubing 13 is negligible, and (b) production from the well will be the stable flow, which means that kinetic energy loss is negligible. The computational model can also employ an equation based on the conservation of energy for the production flow through the tubing string as illustrated in FIG. 5, which is labeled as equation (2) in FIG. 5. The computational model can also employ an iterative method (labeled (3) in FIG. 5) that calculates a value for compressibility factor Z for the fluid flow, which is dependent on the pressure and the temperature of the fluid. The computational model can be solved with a calculation process (labeled (4) in FIG. 5) that uses an iterative method to calculate the bottomhole pressure (BHP or TSP or tubing shoe pressure) from the casing head pressure CHP measured by sensor 29, and then uses the calculated bottomhole pressure together with the tubing head pressure (THP) measured by sensor 27 and values for gas density, liquid density, and wellbore depth to solve the conservation of energy equation and determine the liquid height $H_l$. This process is labeled as a flowing pressure calculation in FIG. 5.

In one embodiment, the computational model of block 307 can account for gas flow from the bottom of the well to the well head based on an assumption of stable fluid flow. In this case, one can consider an element length (dl) of wellbore for analysis based on the energy equation as follows:

$$dp+\rho udv+\rho gdH+dW+dl_w=0 \qquad \text{Eqn. (1)}$$

where dp is the pressure drop of dl, ρ is the density of gas, g is the gravitational acceleration, l is the length of tubing, v is the gas velocity, dW is the power by the outside world on gas, and $dl_w$ is the pressure loss by friction.

For the vertical gas flow, one can assume that there no power in and out, so the dW is 0. Because of stable flow, the kinetic energy loss is 0 and the vdv is 0. So the energy equation (1) can be simplified as follows:

$$\frac{d_p}{\rho}+gdl+\frac{fu^2dl}{2d}=0 \qquad \text{Eqn. (2)}$$

where dp is the pressure drop of dl, ρ is the density of gas, g is the gravitational acceleration, l is the length of tubing, d is the tubing diameter, v is the gas velocity, and f is the coefficient of friction.

One can further assume standard pressure and temperature conditions, such as $P_{sc}$=0.101325 MPa, $T_{sc}$=293K, that relate to a standard gas flow $q_{sc}$ in $m^3/d$, to give the gas velocity (m/s) in the any point of tubing (p, T) as follows:

$$v=\frac{B_g q_{sc}}{A\times 86400}=\frac{q_{sc}}{86400}\left(\frac{T\times 0.101325\times Z}{293p}\right)\frac{1}{\frac{1}{4}\pi d^2} \qquad \text{Eqn. (3)}$$

Furthermore, the density of gas p can be related to the pressure p as follows:

$$\rho=\frac{pM_g}{ZRT}=\frac{28.97\gamma_g p}{0.008314ZT}, \qquad \text{Eqn. (4)}$$

where Z is the gas compressibility factor.

Equations (2)-(4) can be combined to give:

$$\frac{\frac{ZT}{p}dp}{1+\frac{1.324\times 10^{-18}fq_{sc}^2T^2Z^2}{p^2d^5}}=-0.03415\gamma_g dl. \qquad \text{Eqn. (5)}$$

Integral calculus can be applied to Eqn. (5) for the ΔH length between two points 1,2 of the tubing as follows:

$$\int_{p_1}^{p_2}\frac{dp}{\left[p+\left(\frac{1.324\times 10^{-18}\left(q_{sc}\bar{T}\bar{Z}\right)^2}{pd^5}\right)\right]}=\frac{0.03415\gamma_g\Delta H}{\bar{T}\bar{Z}}, \qquad \text{Eqn. (6)}$$

where $$p_2=\sqrt{p_1^2e^{2s}+\left(e^{2s}-1\right)\frac{1.324\times 10^{-18}f\left(q_{sc}\bar{T}\bar{Z}\right)^2}{d^5}},$$

$$\bar{T}=\frac{T_1+T_2}{2},$$

$$S=\frac{0.03415\gamma_g\Delta H}{\bar{T}\bar{Z}},$$

$\bar{Z}$ is the gas compressibility factor between the two points, and $\bar{T}$ is the average temperature of ΔH length.

Furthermore, the gas compressibility factor Z can be related to the dimensionless pseudoreduced pressure and temperature as follows:

$$Z=1-\frac{3.53p_{pr}}{10^{0.9813T_{pr}}}+\frac{0.274p_{pr}^2}{10^{0.8157T}T_{pr}}, \qquad \text{Eqn. (7)}$$

where $p_{pr}$ is the pseudoreduced pressure, dimensionless, and $T_{pr}$ is the pseudoreduced temperature, dimensionless.

The dimensionless pseudoreduced pressure $p_{pr}$ and the dimensionless pseudoreduced temperature $T_{pr}$ can be related to the pressure and temperature, respectively, as follows:

$$P_{pr} = \frac{p}{p_{pc}} \qquad \text{Eqn. (8)}$$

$$T_{pr} = \frac{T}{T_{pc}},$$

where $p_{pc}$ is the pseudoreduced pressure for gas, and $T_{pc}$ is the pseudoreduced temperature for gas. These two parameters are based on the component of gas.

This system of equations relates Z with p and T. We can measure $T_1$, H, and the temperature gradient, and apply the system of equations to calculate $T_2$. When we have the $T_1$, $T_2$, $P_1$, $P_{pc}$, and $T_{pc}$, we can assume the $P_2$ to calculate Z, gas density, and $P_{2'}$. If the absolute value of $(P_2-P_{2'})$ is within a predefined error range, the method has converged and $P_2$ is the second pressure. We call this method an iterative method. This iterative method can be used to calculate the pressure at the bottom of the well (BHP).

In block 309, controller 39 determines a differential liquid height delta-$H_l$, which represents the difference in the liquid height $H_l$ at two different time points. For example, if the liquid height $H_l$ is 3000 m at 1:00 AM, and the liquid height $H_l$ is 2800 m at 4:00 AM, delta-$H_l$ for the time period between 1:00 AM and 4:00 AM is 200 m.

In block 311, controller 39 uses decision logic to determine whether a liquid-loading flag is true or false based on the values for the gas flow rate Q, the critical gas flow rate Qc, the liquid height $H_l$, delta-$H_l$, and possibly other parameters. FIG. 6 is a table where the rows represent conditions that can be evaluated to determine whether the liquid-loading flag is true or false. The label "Don't Care" is used to indicate that the corresponding parameters need not be used in conditions(s) that are evaluated to determine whether the liquid-loading flag is true or false. For example, if $Q \geq Qc$, then the liquid-loading flag is set to false irrespective of the values for the parameters $H_l$, delta-$H_l$, A, B, and C. Furthermore, if $Q<Qc$ and $H_l>A$, then the liquid-loading flag is set to true irrespective of the values for the delta-$H_l$, B and C. Moreover, if $Q<Qc$ and $H_l \leq A$ and delta-$H_l>B$, then the liquid-loading flag is set to true irrespective of the values for the Q and C. However, if $Q<Qc$ and $H_l \leq A$ and delta-$H_l \leq B$, then the liquid-loading flag is set to true when $Q<C$, or the liquid-loading flag is set to false when $Q \geq C$. These conditions employ parameters A, B and C that are determined by analysis of historical production data from a number of gas wells and the liquid loading state reported for such production data.

In block 313, controller 39 evaluates the liquid-loading flag determined in 311. If the liquid-loading flag is true, controller 39 triggers or transitions to the Shut-In Mode of blocks 315 to 325; otherwise controller 39 continues the production mode and repeats the operations of 305 to 313 for follow-on points in time during the production mode.

The shut-in mode begins in block 315 where controller 39 controls choke 25 to operate with a closed setting and records the Close Point (Time) for the current production cycle.

In block 317, controller 39 performs operations for different time-offsets after the Close Point, which involve:

using a trained ML Model to predict gas flow rate; and determining a liquid height $H_l$ from a computational model based on the conservation of energy for static fluids in the well.

In embodiments, the ML model used in block 317 can implement a Decision Tree model, Random Forest ML model, an XG Boost ML model, an Artificial Neural Network model, or another suitable ML model.

In embodiments, the computational model of block 317 is based on fluid mechanics with assumptions (1) that (a) liquid height in the annulus of the well outside the production tubing 13 is negligible, and (b) there is no production from the well such that kinetic energy loss and friction loss can be omitted from the calculation. The computational model can also employ an equation based on the conservation of energy for the static fluids in the tubing string as illustrated in FIG. 5, which is labeled Eqn. (2) in FIG. 5. The computational model can also employ an iterative method (labeled (3) in FIG. 5) that calculates a value for compressibility factor Z for the fluid, which is dependent on the pressure and the temperature of the fluid. The computational model can be solved with a calculation process (labeled (4) in FIG. 5) that uses an iterative method to calculate the bottomhole pressure (or BHP or TSP or tubing shoe pressure) from the casing head pressure CHP measured by sensor 29, and then uses the calculated bottomhole pressure together with the tubing head pressure (THP) measured by sensor 27 and values for gas density, liquid density, and wellbore depth to solve the conservation of energy equation and determine the liquid height $H_l$. This process is labeled as a static pressure calculation in FIG. 5.

Because of the no production from annulus in the shut-in mode, the computational model of block 317 can use a stable pressure calculation method. In this method, the iterative method as described above can be used to calculate the bottom hole pressure (tubing shoe pressure) from the casing top (based on casing head pressure). With the tubing shoe pressure, tubing head pressure, gas density, liquid density and wellbore depth known, one can calculate the liquid height.

In block 319, controller 39 evaluates the liquid height $H_l$ over the different time offsets against a liquid height benchmark (this is based on the historical data analysis) to determine an operational time window where the liquid height $H_l$ is less than the liquid height benchmark.

In block 321, controller 39 evaluates the predicted gas flow rate within the operational time window to find the maximum predicted gas flow rate in the operational time window.

In block 323, controller 39 identifies the time offset for the maximum predicted gas flow rate in the operational time window.

In block 325, controller 39 triggers or transitions to the production mode at the identified time offset to initiate the next production cycle.

In embodiments, choke 25 can be operated in a fully open (or other fixed open setting) in the production mode over time.

In other embodiments, choke 25 can be operated in variable open settings in the production mode over time. In this case, the ML model can predict the gas flow rate for different open settings of the choke 25 and the operations of 317 to 323 can be adapted to identify the time offset and variable open setting of the choke for the maximum predicted gas flow rate in the operational time window. This time offset and open setting of the smart choke as determined from this analysis can then be used when entering the production mode.

Figure 7:
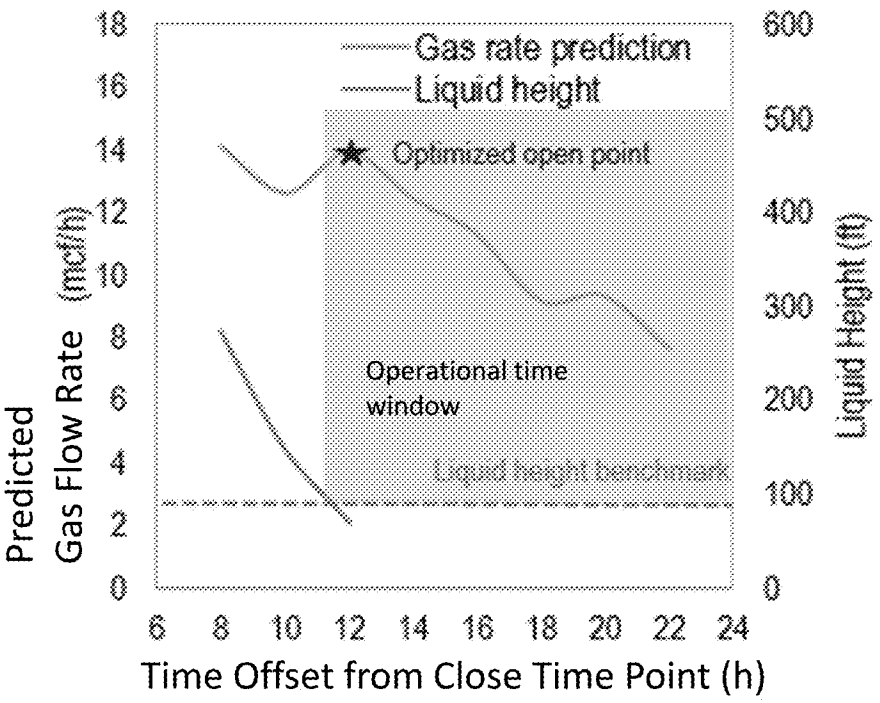
FIG. 7 includes plots that illustrate the operations of FIG. 3 for a gas well operating in the shut-in mode of a representative production cycle.

FIG. 7 includes plots that illustrate the operations of blocks 317 to 323 of FIG. 3 for a gas well operating in the shut-in mode of a representative production cycle. The plots depict liquid height as a function of time offset from the Close Time Point as well as predicted gas flow rate as a function of time offset from the Close Time Point. The operational time window shown corresponds to the time period where the liquid height falls below the liquid height benchmark. The maximum predicted gas flow rate in the operational time window is labeled with a "star" and is used to identify the time offset from the Close Time Point for the maximum predicted gas flow rate in the operational time window.

Figure 8:
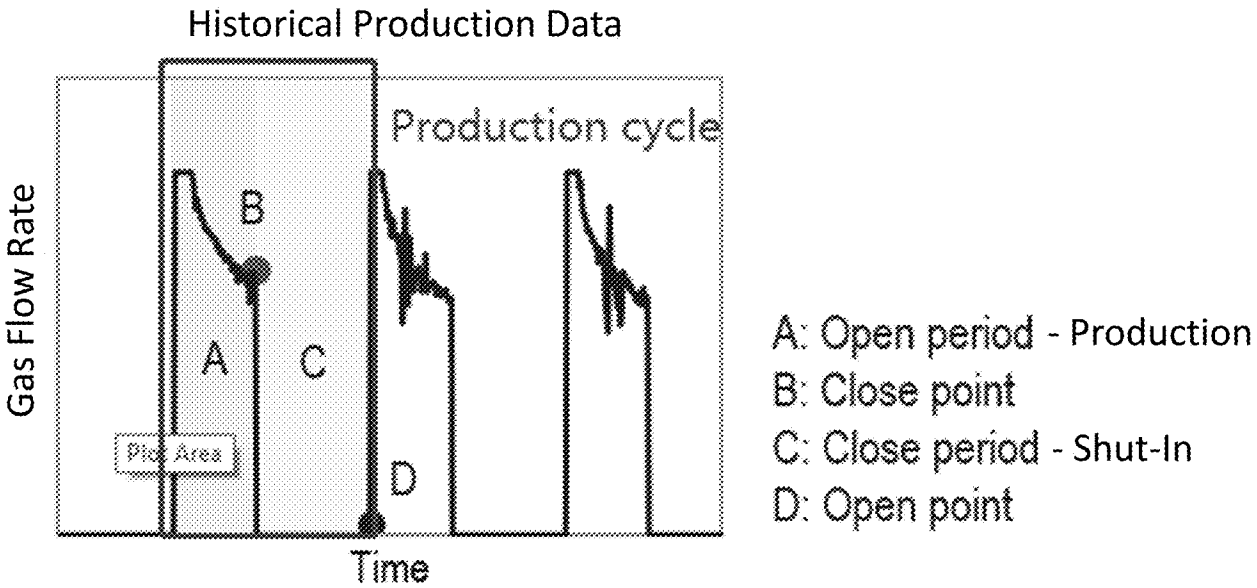
FIG. 8 illustrates historical time-series data for gas flow rate that can be used to train a machine learning model to predict gas flow rate in the shut-in mode.

In embodiments, the ML model used in block 317 can be trained from historical times-series operational data collected during intermittent production from a number of gas wells and stored in a database. The historical time-series operational data can be indicative of various operational parameters (such as gas flow rate, tubing head pressure, casing head pressure, temperature, and possibly other suitable parameters) over time during past intermittent production. The time-series operational data can include timestamps that provide a measure of time in association with the operational parameters. An example of such historical time-series data for gas flow rate is shown in FIG. 8. The historical time-series operational data can be preprocessed for modeling, which can involve data conditioning, data extraction, and labeling. The data conditioning can be configured to filter out outlier parameter information and possibly employ interpolation or other analysis to add missing parameter information (for example, if the logging frequency for a particular data channel is insufficiently low). The data extraction can be configured to extract or calculate relevant or meaningful operational data ("feature data") for respective shut-in periods over the production cycles. For example, the data extraction can determine maximum tubing head pressure and minimum tubing head pressure during respective shut-in periods, maximum casing head pressure and minimum casing head pressure during the respective shut-in periods, and the time duration of the respective shut-in periods. The labeling can be configured to assign labels or tags to the feature data. The labels or tags can be indicative of the gas flow rate for the production periods that follow the respective shut-in periods of the corresponding extracted operational data. For example, the label associated with feature data for a given shut-in period (e.g., a feature data vector representing i) maximum tubing head pressure and minimum tubing head pressure during a given shut-in period, ii) maximum casing head pressure and minimum casing head pressure during the given shut-in period, and iii) time duration of the given shut-in period) can be calculated as the average gas flow rate measured during the production period that follows the given shut-in period. The feature data and the corresponding label data corresponding to the respective shut-in periods and follow-on production periods can be stored as a training dataset and used to train the ML model to predict a gas flow rate given arbitrary feature data as input. In this case, when using the trained ML model to predict gas flow rate in block 317, similar feature data can be extracted or calculated from the real-time operational data measured during the current shut-in mode as well as the time duration corresponding to the variable time offset from Close Point (Time) in the current shut-in mode. Such feature data can be input to the trained ML model, which outputs a value representing predicted gas flow rate for the variable time offset from Close Point (Time) in the current shut-in mode.

Figure 9:
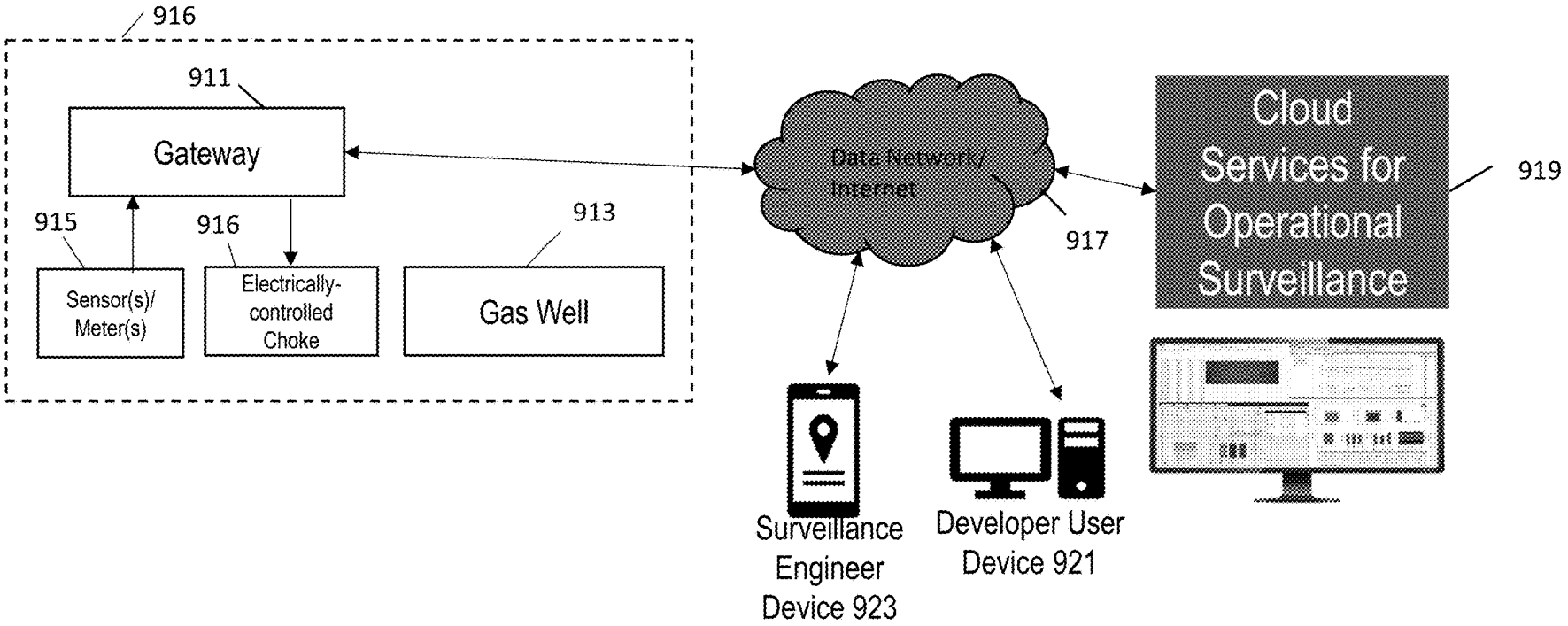
FIG. 9 is a schematic diagram illustrating a distributed computing platform for operational surveillance and control of production of a gas well in accordance with an aspect of the present disclosure.

In embodiments, the methods, systems, and workflows described herein can employ a distributed computing platform configured to implement autonomous control operations for intermittent production from a gas well as shown in FIG. 9. A gas well 913 (for example, see FIG. 1) is located at a well site 916. The distributed computing platform includes a gateway device 911 that is located at or near the well site 916. The gateway device 911 interfaces to the sensors 915 that characterize the operational parameters of the gas well 913 over time. For example, the sensors 915 can correspond to the pressure and temperature sensors 27, 29 and flow meter 31 of FIG. 1. The gateway device 911 also interfaces to a surface-located electrically-controlled choke 916 that controls production from the gas well 913. Sensor data output by the sensors 915 can be collected and/or aggregated and/or otherwise processed by the gateway 911 in real-time. The sensor data collected and/or aggregated and/or otherwise processed by the gateway 911 can be communicated over a data network 917 to cloud services 919, which employ a cloud computing environment that receives such data and processes such data to monitor operating conditions and status of the gas well 913. The data communication network 917 can be a cellular data network, satellite link, the internet, or other modes of data communication.

The cloud services 919 include services that monitor operating conditions of the gas well 913, which is referred to as operational surveillance of such gas well. Such services are typically embodied by software executing in a computing environment, such as a cloud computing environment. An example computing environment is described below with respect to FIG. 10. In this environment, the gateway 911 collects time-series operational data that characterizes the operation of the gas well 913 and forwards such times-series operational data to the cloud services 919. One or more developer users can interface to the cloud services 919 employing device(s) 921 that communicate with the cloud services 919 over the data network 917. The device(s) 921 can be a personal computer, portable computer such as a laptop or tablet, a smart phone or other suitable communication or computing device as described below with respect to FIG. 10. Through operation of the developer user device(s) 921 in communication with the cloud services 919, the developer users can assist in configuration and deployment of the methods and systems and workflows as described herein on the gateway device 911. In response to the detected anomalies and/or to alerts or alarms corresponding to such anomalies, the gateway 911 can control the choke 916 through commands issued remotely from the cloud services 919 or by another system. Alternatively, the gateway 911 can control the choke 916 through commands issued by autonomous control operations performed by the gateway 911. Furthermore, the cloud services 919 can be configured to notify one or more users (who are referred to as "surveillance engineers" herein and can be one or more engineers or other users responsible for monitoring and managing the operation of the gas well 913). For example, the surveillance engineer(s) can be notified by messaging (e.g., email messaging or in-app messaging) and/or by presentation and display of an alert or alarm or other visual or multimedia representation corresponding to a detected anomaly event. Such messaging can relate to repair and maintenance of the gas well 913 where appropriate. To support notification of surveillance engineer(s), the surveillance engineer(s) can interface to the cloud services 919 employing device(s) 923 that communicate with the cloud services 919 over the data network 917. The surveillance engineer device(s) 923 can be a personal computer, portable computer such as a laptop or tablet, a smart phone, or other suitable communication or computing device as described below with respect to FIG. 10.

In embodiments, the gateway device 911 can include applications that implement autonomous control operations for intermittent production from the gas well 913. Such applications are typically embodied by software executing in a computing environment. In this environment, the applications of the gateway 911 collect time-series operational data that characterizes operation of the gas well 913 from the sensors 915. The applications deployed or installed on the gateway device 911 can be configured to implement autonomous control operations that process the time-series operational data to dynamically adjust or control the choke 916 to carry out intermittent production according to the processing of the controller as described herein.

In other embodiments, applications deployed or installed on the cloud service 919 can be configured to implement autonomous control operations that process the time-series operational data supplied thereto to communicate and cooperate with the gateway 911 to dynamically adjust or control the choke 916 to carry out intermittent production according to the processing of the controller described herein.

Figure 10:
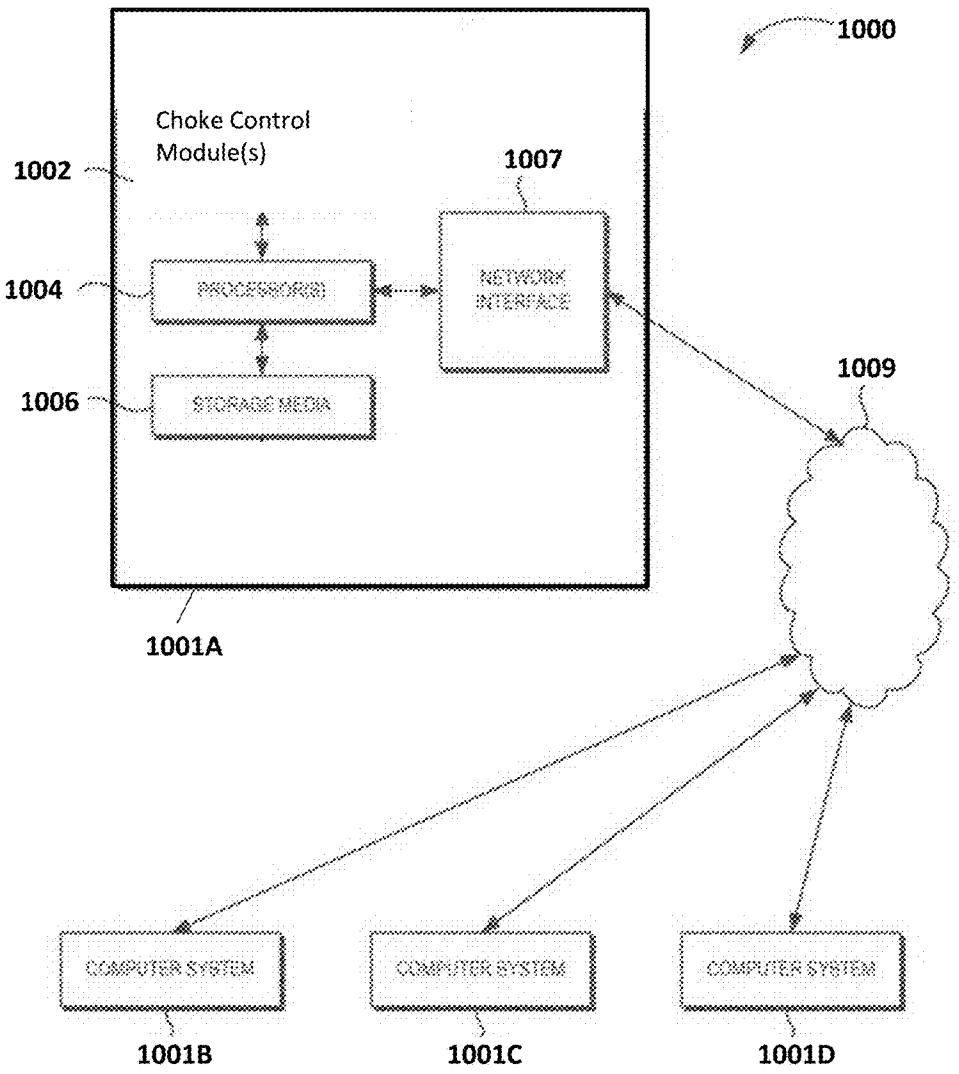
FIG. 10 depicts an example computing environment.

In some embodiments, the methods of the present disclosure may be executed by a computing system. FIG. 10 illustrates an example of such a computing system 1000, in accordance with some embodiments. The computing system 1000 may include a computer or computer system 1001A, which may be an individual computer system 1001A or an arrangement of distributed computer systems. The computer system 1001A includes one or more control modules 1002 that are configured to perform various tasks according to some embodiments, such as one or more methods or portions thereof as disclosed herein. To perform these various tasks, the control module(s) 1002 executes independently, or in coordination with, one or more processors 1004, which is (or are) connected to one or more storage media 1006. The processor(s) 1004 is (or are) also connected to a network interface 1007 to allow the computer system 1001A to communicate over a data network 1009 with one or more additional computer systems and/or computing systems, such as 1001B, 1001C, and/or 1001D. Note that computer systems 1001B, 1001C and/or 1001D may or may not share the same architecture as computer system 1001A, and may be located in different physical locations, e.g., computer systems 1001A and 1001B may be located in a processing facility, while in communication with one or more computer systems such as 1001C and/or 1001D that are located in one or more data centers, and/or located in varying countries on different continents).

The processor 1004 may include a microprocessor, microcontroller, processor module or subsystem, programmable integrated circuit, programmable gate array, or another control or computing device.

The storage media 1006 may be implemented as one or more computer-readable or machine-readable storage media. Note that while in the example embodiment of FIG. 10 storage media 1006 is depicted as within computer system 1001A, in some embodiments, storage media 1006 may be distributed within and/or across multiple internal and/or external enclosures of computing system 1001A and/or additional computing systems. Storage media 1006 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions or located at a remote site from which machine-readable instructions may be downloaded over a network for execution.

It should be appreciated that computing system 1000 is only one example of a computing system, and that computing system 1000 may have more or fewer components than shown, may combine additional components not depicted in the example embodiment of FIG. 10, and/or computing system 1000 may have a different configuration or arrangement of the components depicted in FIG. 10. The various components shown in FIG. 10 may be implemented in hardware, software, or a combination of both hardware and software, including one or more signal processing and/or application-specific integrated circuits.

Further, the steps in the processing methods and workflows described herein may be implemented by running one or more functional modules in information processing apparatus such as general-purpose processors or application-specific chips, such as ASICs, FPGAs, PLDs, or other appropriate devices. These modules, combinations of these modules, and/or their combination with general hardware are all included within the scope of protection of the invention.

Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general-purpose computer) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for producing gas in association with liquids from a well, wherein production tubing disposed in the well provides a flow path for gas and liquids to a surface, the method comprising:

disposing an electrically-controlled choke and a controller at the surface, wherein the choke is in fluid communication with the production tubing, and wherein the controller interfaces to the choke; and executing autonomous control operations on the controller that control operation of the choke, wherein the autonomous control operations involve production cycles that include a production mode followed by a shut-in mode;

wherein, in the production mode, the controller is configured to operate the choke in an open position;

wherein, in the shut-in mode, the controller is configured to operate the choke in a closed position; and wherein, in the production mode, the controller is configured to perform operations that involve determining a liquid height over time from a first computational model and automatically and selectively transitioning to the shut-in mode based on the liquid height, wherein the liquid height represents height or depth level of liquid loading in the well, and wherein the first computational model is based on conservation of energy for production flow through the production tubing.

2. The method according to claim 1, wherein the determining comprises determining whether a liquid-loading flag is true or false over time based at least in part on values for the liquid height over time in the production mode, and wherein the automatically and selectively transitioning to the shut-in mode is based on the liquid-loading flag.

3. The method according to claim 1, wherein:

the first computational model is configured to relate measured operating parameters and static parameters to the liquid height.

4. The method according to claim 1, wherein:

the first computational model is based on fluid mechanics with assumptions that (a) liquid height in an annulus of the well outside the production tubing is negligible, and (b) production from the well will be stable flow, which means that kinetic energy loss is negligible.

5. The method according to claim 1, wherein:

the first computational model employs an iterative method that calculates a value for a compressibility factor for the fluid flow.

6. The method according to claim 1, wherein:

the first computational model calculates bottomhole pressure from measured casing head pressure, and then uses the calculated bottomhole pressure together with measured tubing head pressure and values for gas density, liquid density, and wellbore depth to determine the liquid height.

7. The method according to claim 2, wherein:

determining whether the liquid-loading flag is true or false over time is further based on comparing measured gas flow rate to a critical gas flow rate determined from another computation model.

8. The method according to claim 2, wherein:

determining whether the liquid-loading flag is true or false over time is further based on differential liquid height calculated during the production mode.

9. The method according to claim 1, wherein, in the shut-in mode, the controller is configured to perform operations that involve:

i) determining a liquid height over time from a second computational model, wherein the liquid height represents height or depth level of liquid loading in the well, and wherein the second computational model is based on the conservation of energy for static fluids in the well;

ii) determining an observation time window where the liquid height over time in the shut-in mode falls below a threshold level;

iii) predicting gas flow rate for different points in time within the observation time window using a trained machine learning model;

iv) identifying a point in time in the observation time window that corresponds to a maximum predicted gas flow rate within the observation time window; and v) automatically and selectively transitioning to the production mode at the point in time identified in iv).

10. The method according to claim 9, wherein:

the second computational model is based on fluid mechanics with assumptions that (a) liquid height in an annulus of the well outside the production tubing is negligible, and (b) there is no production from the well such that kinetic energy loss and friction loss can be omitted from the calculation.

11. The method according to claim 9, wherein:

the second computational model employs an iterative method that calculates a value for a compressibility factor for the fluid.

12. The method according to claim 9, wherein:

the second computational model calculates bottomhole pressure from measured casing head pressure, and then uses the calculated bottomhole pressure together with measured tubing head pressure and values for gas density, liquid density, and wellbore depth to determine the liquid height.

13. The method according to claim 9, wherein:

the controller is configured to operate the choke in a fully open or other fixed open setting in the production mode over time.

14. The method according to claim 9, wherein:

the controller is configured to operate the choke in variable open settings in the production mode over time.

15. The method according to claim 9, wherein:

the controller is configured to operate the choke in variable open settings based on predictions of the gas flow rate made using a machine learning (ML) model for different open settings of the choke.

16. The method according to claim 1, wherein:

the controller is implemented by a gateway device located at or near a well site, wherein the gateway device is configured to collect real-time operational data related to production of gas and liquids from the well.

17. The method according to claim 1, wherein:

the controller is implemented by a cloud computing environment that communicates with a gateway located at or near a well site, wherein the gateway is configured to collect real-time operational data related to production of gas and liquids from the well and to forward the real-time operational data to the cloud computing environment.

18. A system for controlling production from a well, wherein production tubing disposed in the well provides a flow path for gas and liquids to a surface, the system comprising;

at least one sensor configured to measure data related to operation of the well;

an electrically-controlled choke in fluid communication with the production tubing; and a gateway device operably coupled to the at least one sensor and the electrically-controlled choke;

wherein the gateway device is configured to generate or collect or obtain time-series operational data from the data measured by the at least one sensor, and execute autonomous control operations that control operation of the choke, wherein the autonomous control operations involve production cycles that include a production mode followed by a shut-in mode;

wherein, in the production mode, the gateway device is configured to operate the choke in an open position;

wherein, in the shut-in mode, the gateway device is configured to operate the choke in a closed position; and wherein, in the production mode, the gateway device is configured to perform operations that involve determining a liquid height over time from a first computational model and automatically and selectively transitioning to the shut-in mode based on the liquid height, wherein the liquid height represents height or depth level of liquid loading in the well, and wherein the first computational model is based on conservation of energy for production flow through the production tubing.

19. The system according to claim 18, wherein the determining comprises determining whether a liquid-loading flag is true or false over time based at least in part on values for the liquid height over time in the production mode, and wherein the automatically and selectively transitioning to the shut-in mode is based on the liquid-loading flag.

20. The system according to claim 18, wherein, in the shut-in mode, the gateway device is configured to perform operations that involve:

i) determining a liquid height over time from a second computational model, wherein the liquid height represents height or depth level of liquid loading in the well, and wherein the second computational model is based on the conservation of energy for static fluids in the well;

ii) determining an observation time window where the liquid height over time in the shut-in mode falls below a threshold level;

iii) predicting gas flow rate for different points in time within the observation time window using a trained machine learning model;

iv) identifying a point in time in the observation time window that corresponds to a maximum predicted gas flow rate within the observation time window; and v) automatically and selectively transitioning to the production mode at the point in time identified in iv).

* * * * *